United States Patent [19]

Haugen et al.

[11] Patent Number: 4,732,211

[45] Date of Patent: Mar. 22, 1988

[54] ANNULUS PRESSURE OPERATED VENT ASSEMBLY

[75] Inventors: David M. Haugen, Houston; David S. Wesson, Katy; Robert R. Luke, Houston; Kevin R. George, Columbus, all of Tex.

[73] Assignee: Halliburton Company, Duncan, Okla.

[21] Appl. No.: 894,101

[22] Filed: Aug. 7, 1986

[51] Int. Cl.[4] ..... E21B 43/116; E21B 34/10

[52] U.S. Cl. ..... 166/55.1; 166/142; 166/321

[58] Field of Search ..... 166/55.1, 297, 374, 166/386, 317, 321, 319, 323, 142, 143, 126, 151, 152, 116

[56] References Cited

U.S. PATENT DOCUMENTS

| | | | |
|---|---|---|---|
| 2,984,303 | 5/1961 | Baker | 166/321 |
| 3,970,147 | 7/1976 | Jenup et al. | 166/323 X |
| 4,274,486 | 6/1981 | Fredd | 166/319 X |
| 4,452,313 | 6/1984 | McMahan | 166/373 |
| 4,512,406 | 4/1985 | Vann et al. | 166/297 |
| 4,515,217 | 5/1985 | Stout | 166/297 |
| 4,564,076 | 1/1986 | Vann et al. | 166/297 X |
| 4,655,298 | 4/1987 | George et al. | 175/4.52 |

*Primary Examiner*—James A. Leppink
*Assistant Examiner*—Hoang C. Dang
*Attorney, Agent, or Firm*—James R. Duzan

[57] ABSTRACT

A vent subassembly includes a vent body having an opening which is covered or uncovered dependent upon the location of a vent sleeve relative to the vent body. The vent subassembly can be connected below a packer, and the vent sleeve can be connected to a perforator so that movement of the vent sleeve is concurrently communicated to the perforator, such as for initiating the firing of the perforator. The vent sleeve is moved by an actuator subassembly, which is to be connected above the packer if the vent and actuator subassemblies are used with a packer. The actuator subassembly has a piston housing, a piston slidably disposed in the piston housing, and a connector string extending from the piston to the vent sleeve. The piston is responsive to a differential pressure existing between the annulus outside the actuator subassembly and an interior pressure within the actuator subassembly.

24 Claims, 6 Drawing Figures

ANNULUS PRESSURE OPERATED VENT ASSEMBLY

BACKGROUND OF THE INVENTION

This invention relates generally to vent tools used in subterranean well bores and more particularly, but not by way of limitation, to a vent tool having a vent subassembly connectible below a packer and an actuator subassembly connectible above the packer but in association with the vent subassembly to communicate an operating action to the vent subassembly in response to an actuating differential pressure force existing between the annulus and the inner diameter of a tubing string to which the actuator subassembly is connected, which operating action is, even more particularly, communicated to a perforator to concurrently initiate firing of explosive charges within the perforator.

In perforating a subterranean formation intersected by a well bore, vent tools are sometimes used to surge the perforations which have been created in the formation by explosive charges in a perforating gun of a perforator. For example, a vent can be used with a tubing conveyed perforator which will be followed by a gravel pack. The formation will first be fabricated under a balanced condition with the vent closed. Thereafter, the vent will be opened to surge the perforation, after which fluid will be reversed out of the tubing and the assembly removed from the well bore. The well will then be gravel packed. Such a vent and perforator will be run into the well bore on a tubing string and generally used with a packer also connected as part of the tubing string. In this instance, the vent and the perforator are located below the packer in the tubing string.

The need for such type of vent tool is well known in the industry. Vents have been proposed or used which are pressure actuated. Some respond to a tubing pressure applied down through the tubing string to where the vent is located. Others respond to annular pressure in the "rathole" below the packer where the vent is located. Still others respond to a pressure differential created in the vent relative to a prepressurized chamber contained within the vent. All of these require use of a fluid pressure at the location where the vent is disposed, such as below a packer. This may require a relatively complex venting assembly or a relatively complex coupling for coupling to the packer. To obviate this complexity, there is the need for a vent tool which has a simplified construction easily connectible to a packer or into a tubing string and which can be actuated by a force existing or exerted from above the packer or, more broadly, at a location spaced from where the venting is to occur. This need calls for a unique coupling arrangement or operational relationship between the physically spaced venting structure and actuating structure. This uniqueness arises not only from the need to have the actuating structure respond to a force where it is located and then to communicate a resultant operation to the vent, but also to accommodate spacing differentials between the venting structure and the actuating structure. This coupling should be designed to facilitate relatively easy connecting and disconnecting between the venting and actuating structures.

Another desirable feature would be for the design to allow the venting structure to be interconnected or associated with the actuating structure after the packer (where used) and venting structure have been made into the tubing string and lowered through the mouth of the well bore. This would facilitate the making of the connections between the venting structure and the tubing string because the actuating structure would not at that time have to be also connected.

Another desirable feature would be to have some means for mechanically locking the vent structure open without requiring a sustained external force to be applied to the vent structure.

Still another desirable feature would be for the unique association between the venting and actuating structures to provide concurrent initiation of the firing of the perforator if one is connected into the tubing string.

SUMMARY OF THE INVENTION

The present invention overcomes the above-noted and other shortcomings of the prior art and satisfies the aforementioned needs by providing a novel and improved annulus pressure operated vent assembly. In the present invention actuation of the vent occurs from a force existing at a location spaced from where the venting is to occur, which force in a preferred embodiment is particularly a differential pressure existing between the annulus and the inner diameter of a tubing string above where the venting is to occur. A resultant operating action of any suitable type is then communicated through any intervening spatial separation to operate the vent.

In a preferred embodiment differential spatial separations between an actuator which responds to the spaced force and a vent which is operated by the actuator can be accommodated. The actuator of a preferred embodiment can be connected to the vent after the vent has been made up into the tool string and lowered into the well bore. The actuator can be disconnected on pull-out from the well bore without having to remain intact with the lower located vent or any intervening packer. Also in a preferred embodiment, the vent is constructed so that it is mechanically locked in an open position without requiring any continuous external force to be applied to the vent. A preferred embodiment also includes a coupling which couples the vent to a perforator to initiate firing of the perforator in response to the same motion actuating the vent. Additionally, the actuator structure of a preferred embodiment includes a novel shear pin set retaining structure which facilitates construction of the actuator.

In general, the present invention provides an apparatus for communicating an annulus outside a tubing string with an interior of the tubing string when the tubing string is disposed in a well. This apparatus comprises a vent connectible into the tubing string and controllable between closed and open states; and it also comprises actuating means, disposable in the well, for actuating the vent to one of the states in response to a differential bias acting on the actuating means within the well at a location spaced from the vent. In the preferred embodiment the differential bias includes a differential pressure force exerted between a pressure in the annulus and a pressure in the interior of the actuating means.

The actuating means is broadly anything which can operate the vent in response to the bias exerted at a location spaced from the vent. This could be by mechanically linked movement or otherwise, such as chemical reaction (e.g., detonating an explosive), or hydraulic communication. In a preferred embodiment, the actuating means includes connector means for connecting the actuating means to the vent at a selectable distance above the vent. This connector means can communicate a positional displacing movement through a packer to the vent in response to the differential pressure force when the vent is connected below the packer and the actuating means is connected above the packer. In a preferred embodiment the connector means includes engagement means for engaging the connector means with the vent after the vent has been connected in the tubing string and lowered trough the mouth of the well bore. This preferred engagement means is of a type which can be disconnected from the vent in response to a rotational force.

In a particular embodiment the actuating means includes a piston housing connectible into the tubing string, a piston disposed in the piston housing, the connector means which is used for connecting the piston to the vent, and holding means for holding the piston stationary relative to the piston housing until the differential bias, which acts on this holding means, exceeds a predetermined magnitude.

The vent of a preferred embodiment of the present invention includes a vent body connectible to the tubing string, and it also includes a vent sleeve slidably received in the vent body. The vent also includes latch means for latching the vent in the open state after the vent has been actuated to the open state by the actuating means. This vent further includes means for preventing the vent sleeve from rotating relative to the vent body when a rotational force is applied to the connector means to disconnect it from the vent sleeve.

In a preferred embodiment wherein the apparatus is used in a tubing string to which a perforator is connected, the apparatus also comprises coupling means for coupling the vent and the perforator so that actuation of the vent by the actuating means also provides an initiating force to the perforator.

Therefore, from the foregoing, it is a general object of the present invention to provide a novel and improved vent assembly, particularly one operated in response to annulus pressure at a location spaced from where the venting is to occur. Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENT

Figure 1:
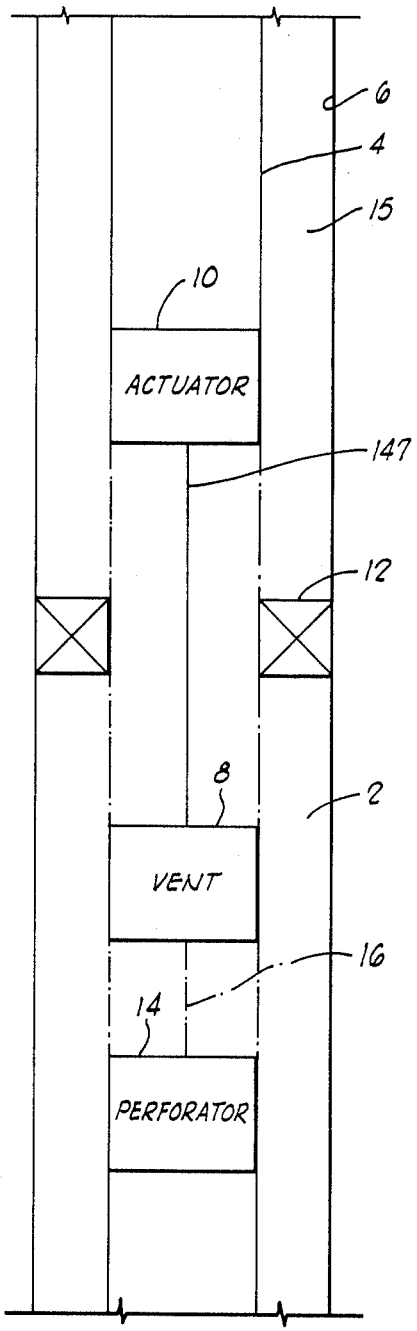
FIG. 1 is a schematic illustration of the vent assembly of the present invention connected into a tubing string including a packer and a perforator.

A particular environment in which the preferred embodiment of the present invention is contemplated to be used is illustrated in FIG. 1. In this illustration the present invention provides an apparatus for communicating an annulus 2 between a tubing string 4 and a well bore 6 with an interior of the tubing string 4. This apparatus includes a vent 8 which is connectible into the tubing string 4 and controllable between closed and open states. This apparatus also includes an actuator 10, disposable in the well and, particularly, connectible into the tubing string 4, for actuating the vent 8 to one of the closed or open states in response to a differential bias acting on the actuating means within the well at a location spaced from the vent 8.

In the particular environment shown in FIG. 1, the vent 8 and the actuator 10 are connected into the tubing string 4 on opposite sides of a packer 12, which is also connected as part of what is referred to herein as the tubing string 4. Also forming part of this tubing string 4 in the FIG. 1 illustration is a perforator 14 which contains explosive devices which can be detonated to perforate a formation intersected by the well bore 6.

When the packer 12 is used, it limits the annulus 2 to that annular portion extending below the packer 12 and between the tubing string 4 and the well bore 6. This annular portion below the packer 12, referred to as the "rathole," is ultimately communicated with the tubing string inner diameter in response to the pressure differential between the pressure in an annulus 15 extending above the packer 12 and the pressure in the tubing string 4 prior to communication of the "rathole" with the tubing string interior. When a packer is not used, actuation still occurs in response to the pressure differential between the annulus and the tubing string, but which annulus is not limited by a packer. Regardless of whether a packer is used, it is apparent from FIG. 1 that the vent 8 is operated in response to a pressure differential occurring at the actuator 10, which is at a spaced location from the vent 8 (even if the actuator 10 is placed physically adjacent the vent 8).

In this illustration the construction or components of the well bore 6, the packer 12 and the perforator 14 are of types as known to the art as are outer tubing sections interconnecting these components into the tubing string 4. It should be noted that in FIG. 1 certain of these intermediate outer tubing sections are represented by dot/dash lines in FIG. 1. These lines ae so drawn to indicate that the spacing indicated thereby is only exemplary and that the components of the present invention and the illustrated environment can be otherwise connected, such as by being connected immediately adjacent each other or spaced at any suitable spacing by the intermediate tubing sections. Also shown by a dot/dash line is a coupling 16 coupling the vent 8 to the perforator 14 in a preferred embodiment of the present invention.

The preferrred embodiment of the apparatus of the present invention which includes the vent 8, the actuator means 10 and the coupling 16 will be described with reference to FIGS. 2, 3A–3B and 4A–4B.

Figure 2:
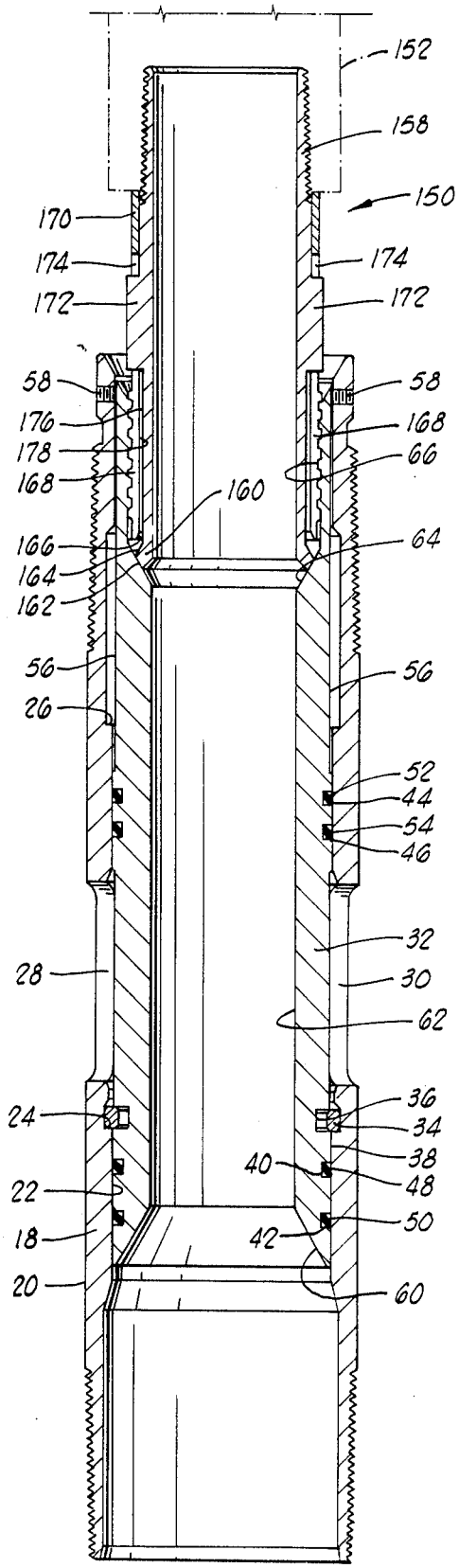
FIG. 2 is a sectional view of a vent subassembly constructed in accordance with a preferred embodiment of the present invention.

The vent 8 of the preferred embodiment shown in FIG. 2 is constructed in a normally closed configuration; however, it can be constructed in a normally open design for use where that is desired. The vent 8 includes an outer vent body 18 defined by a substantially cylindrical wall having an outer surface 20 and an inner surface 22. The outer surface 20 is threaded at its upper end so that the vent body 18 can be connected to the packer 12 through a standard outer string coupling. The surface 20 is threaded at its lower end to receive a suitable coupling for linking the vent body 18 with the perforator 14.

The inner surface 22 has a circumferential indentation defined in part by an annular shoulder surface 24. A longitudinally longer circumferential indentation having an annular shoulder surface 26 is also defined in the surface 22.

Defined through the vent body 18 in between the shoulder surfaces 24, 26 is a port including two openings or holes 28, 30. These openings 28, 30 can be covered or uncovered to place the port and the vent 8 in either a closed state or an open state dependent upon the position of an inner vent sleeve 32 slidably disposed in the axial cavity defined throughout the length of the vent body 18. When the vent sleeve 32 is in the position illustrated in FIG. 2 relative to the vent body 18, it blocks the openings 28, 30 so that the vent 8 is in its closed state. During assembly, this state is obtained by inserting the inner vent sleeve 32 into the vent body 18 until a resilient C-ring 34 engages the annular shoulder surface 24. The ring 34 is carried in a circumferential groove 36 defined around the periphery of the substantially cylindrically shaped inner vent sleeve 32.

When the inner vent sleeve 32 is moved upward (as viewed in FIG. 2) relative to the vent body 18 until the ring 34 engages the annular shoulder surface 26, the inner vent sleeve 32 then unblocks the openings 28, 30 so that the vent 8 is then in its open state. The resiliency of the ring 34 maintains an outward bias on the ring 34 so that its engagement with the surface 26 locks the inner vent sleeve 32 in this open position. Thus, the ring 34 in cooperation with the locking shoulder surface 26 defines a latch means for latching the vent in the open state after the vent has been actuated to this state by the actuating means 10.

Also defined in an outer surface 38 of the inner vent sleeve 32 are circumferential grooves 40, 42 positioned below the groove 36. Still other grooves 44, 46 are defined in the surface 38 above the groove 36. The grooves 40, 42, 44, 46 receive O-rings 48, 50, 52, 54, respectively, which sealingly engage the inner surface 22 of the outer vent body 18. The seals 48, 50 are suitably spaced from the seals 52, 54 so that there is defined a suitable sealing region encompassing the openings 28, 30 when the vent is in its closed state.

Also defined in the outer surface 38 of the sleeve 32 are four longitudinal slots 56, two of which are identified in FIG. 2. These slots cooperate with respective pipe plugs 58 threadedly connected through respective openings in the outer vent body 18. The plugs 58 engage the radially and longitudinally extending side surfaces of the grooves 56 to prevent the vent sleeve 32 from rotating relative to the vent body 18 when a rotational force is applied to the actuating means 10 to disconnect the actuating means 10 from the vent 8 in a manner subsequently described. Although the pipe plugs 58 engage the radial, longitudinal side surfaces of the grooves 56, the grooves 56 are longitudinally long enough to permit sufficient relative longitudinal movement between the sleeve 32 and the body 18 to allow the change in open and closed states of the port defined in the vent 8.

The inner vent sleeve 32 has a hollow chamber defined axially throughout its length by a lower beveled surface 60, a longitudinal surface 62, an upper beveled surface 64, and a threaded surface 66. The threaded surface 66 connects with the actuating means 10 as subsequently described.

Figure 3A:
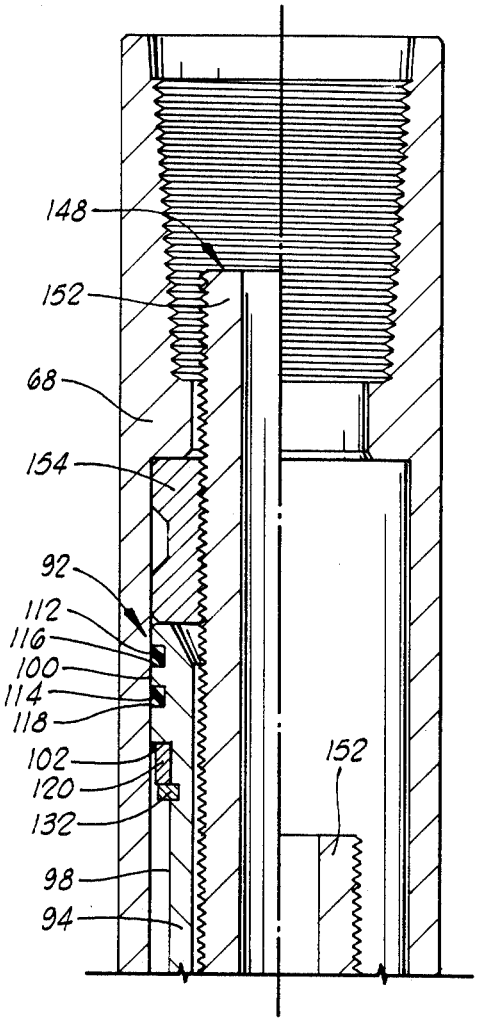
FIGS. 3A and 3B show a partially split sectional view of an actuator subassembly constructed in accordance with a preferred embodiment of the present invention.
Figure 3B:
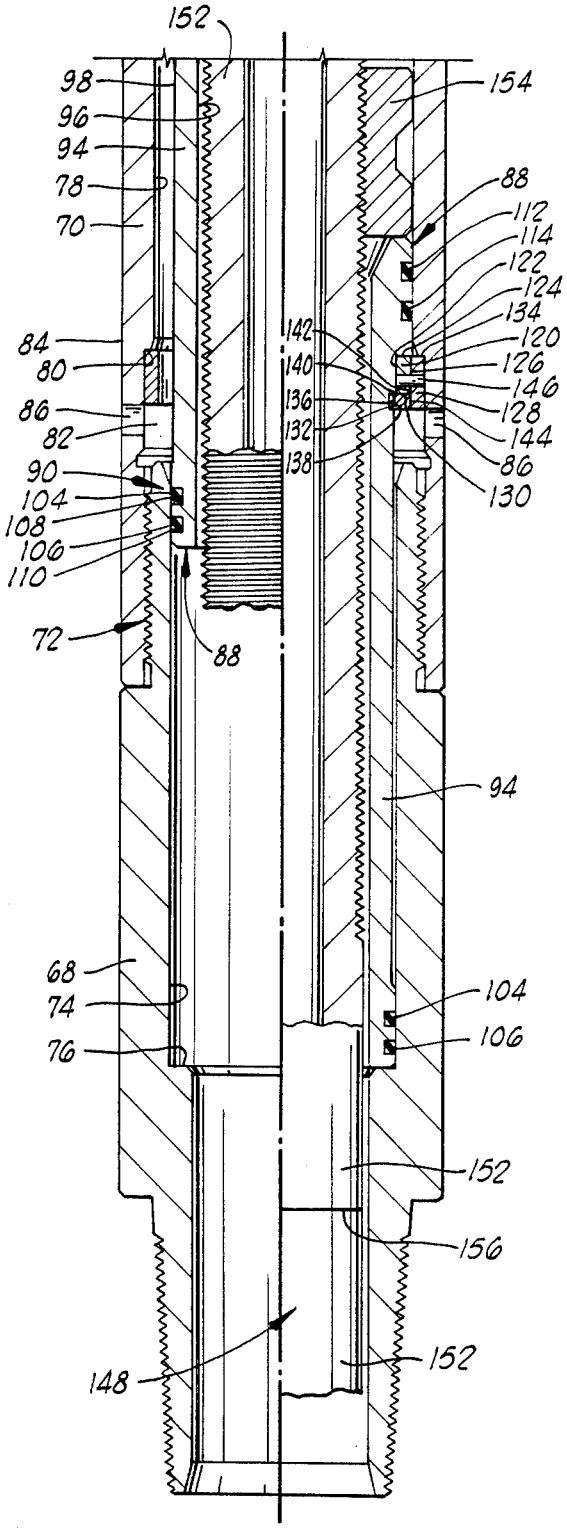

The portion of the actuating means 10 shown in FIGS. 3A and 3B includes a support housing which is specifically a piston housing in the preferred embodiment. The support housing is made up of a lower adapter 68 and an upper adapter 70 threadedly connected at a joint 72.

The other end of the adapter 68 connects to the outer tubing string 4 either at or above the packer 12 in the exemplary environment illustrated in FIG. 1. The adapter 68 has a cylindrical inner surface 74 from which an annular surface 76 radially inwardly extends.

The adapter 70 connects at its upper end to the outer tubing string 4 extending up to the surface through which the well bore 6 is drilled. The adapter 70 has a cylindrical inner surface 78 from which an annular surface 80 radially outwardly extends to another cylindrical inner surface, identified by the reference numeral 82. Defined radially outwardly from the surface 82 to an outer surface 84 of the adapter 70 are a plurality of apertures 86, two of which are shown in FIG. 3B. These apertures allow a pressure within the well bore, such as the annulus 15 in FIG. 1, to communicate into a cavity region defined, at least in part, by the surfaces 78, 80, 82 within the adapter 70.

In view of the communication of the pressure from the well bore into the adapter 70, there is established a differential bias acting on a piston 88 slidably disposed in the housing defined by the coupled adapters 68, 70. In the illustrated embodiment, this differential bias is a differential pressure force exerted between the pressure in the annulus 15 communicated through the apertures 86 and a pressure in the interior of the actuating means 10 outside a sealed region defined by seals 90, 92 carried on the piston 88 on opposite sides of the apertures 86. In the preferred embodiment this pressure within the housing outside of the sealed area is the pressure within the tubing string 4.

The piston 88 has a substantially annular shape with a cylindrical side wall 94 having a cylindrical inner surface 96 defining an axial opening throughout the length of the piston 88. The side wall 94 has cylindrical outer surfaces 98, 100 separated by an annular surface 102. The surface 100 has a diameter substantially equal to the inner diameter of the surface 78 of the adapter 70; however, the surface 98 is radially inwardly offset to a diameter substantially equal to the inner diameter defined across the surface 74 of the adapter 68. This defines a variable length annular region between the surface 98 and the surface 78. The length is variable dependent upon the relative longitudinal rlationship between the piston 88 and the adapter 70.

The seal 90 is defined by O-rings 104, 106 mounted in circumferential grooves 108, 110, respectively, defined in the lower end of the surface 98 of the piston 88 so that the O-rings 104, 106 sealingly engage the surface 74 of the adapter 68 below the apertures 86.

The seal 92 is defined by O-rings 112, 114 mounted in grooves 116, 118, respectively, defined circumferentially into the surface 100 of the piston 88. The O-rings 112, 114 sealingly engage the surface 78 of the adapter 70 above the apertures 86.

When the piston 88 is initially assembled into the housing including the adapters 68, 70, the piston 88 is held stationary relative to the piston housing in the position shown in the right half of FIG. 3B. This positioning is obtained by a suitable means for holding the piston 88 stationary relative to the piston housing until the differential pressure force acting on the piston 88 and the holding means exceeds a predetermined magnitude. That is, once the predetermined magnitude is exceeded by the acting force, the holding means is broken, whereupon the piston 88 can be moved relatively upwardly to the position illustrated by the partial view of the piston 88 on the left-hand side of FIGS. 3A and 3B.

This holding means includes an inner cylindrical collar 120 having an inner surface 122 disposed adjacent the surface 98 of the piston 88 and further having a radial surface 124 abutting the annular surface 102 of the piston 88. Disposed adjacent an outer cylindrical surface 126 of the collar 120 is an outer collar 128. Disposed adjacent a lower radial surface 130 is a split support ring 132. The collar 128 has a radial surface 134 abutting the annular surface 80 of the adapter 70. The ring 132 has a cylindrical surface 136 and a radial surface 138 engaging a groove 140 defined circumferentially around the surface 98 of the piston 88. The collar 128 depends below the lower radial surface 130 of the collar 120 so that a surface 142 of the collar 128 acts against a surface 144 of the ring 132 to maintain the ring 132 in the groove 140. The collar 120 has a radial hole aligned with a radial hole defined through the collar 128, through both of which a shear pin 146 extends to hold the piston 88 in its lower stationary position relative to the adapter 70 until the pressure differential between the annular pressure and the tubing pressure is sufficient to overcome the holding strength of the shear pin 146. Thus, the inner collar 120 engages the piston 88, the ring 132 supports the inner collar 120, the outer collar 128 disposed radially outward of the inner collar 120 engages the inner collar 120 and the piston housing, and the shear pin 146 connects the inner and outer collars 120, 128.

When the differential pressure force acting upwardly against the surface 138 of the ring 132 overcomes the holding strength of the shear pin 146, whereby the piston 88 is moved upward to the position illustrated in the left-hand side of FIGS. 3A and 3B, this impacts a single upward movement or positional displacing movement which needs to be communicated to the inner vent sleeve 32 to actuate the vent 8 from its closed state illustrated in FIG. 2 to its open state wherein ring 38 engages the surface 26 of the outer vent body 18. This communication in the preferred embodiment is by means of a connector means 147 extending concentrically within the outer tubing string 4 and through the central bore of the packer 12 in the environment illustrated in FIG. 1. The preferred embodiment of this connector means, which is moved by the moving means defined by the piston 88 and its responsiveness to the differential pressure force, will be described with reference to FIGS. 2, 3A and 3B illustrating different portions of this embodiment of this connector means.

By the construction of the preferred embodiment of the connector means, the connector means provides means both for connecting the actuating means 10 to the vent 8 at a selectable distance above the vent 8 and for connecting the actuating means 10 to the vent 8 so that the connectors means can be disconnected from the vent 8 in response to a rotational force applied to the connector means. These features are particularly implemented in the preferred embodiment by a pull string 148 (FIGS. 3A–3B) and engagement means 150 (FIG. 2) for engaging the connector means with the vent 8 after the vent has been connected in the tubing string 4 and lowered through the mouth of the well bore 6.

The pull string 148 includes one or more sections of tubing 152. As illustrated in FIGS. 3A and 3B, an uppermost section of the tubing 152 has a threaded end extending through and above the piston 88. Additional, unthreaded sections of the tubing 152 can be connected below the threaded section as needed to obtain a length which is approximately equal to the spacing needed between the vent 8 and the actuating means 10 for a particular job. To accommodate more closely the specific distance between the vent 8 and the actuating means 10, the pull string 148 further includes a split nut 154, disposed above the piston 88 between the inner surface 78 of the adapter 70 and the threaded upper end of the inner tubing section 152 exending above the piston 88, for engaging this threaded upper end as illustrated in FIGS. 3A and 3B. That is, when the actuating means 10 is to be coupled into the tubing string 4, sufficient unthreaded pipe sections 152 are moved down through the tubing string 4 and the packer 12 into engagement with the vent 8 (by a suitable engagement mechanism, such as the engagement means 150 subsequently described) until sufficient unthreaded sections 152 have been used to just enter the lower end of the adapter 68 connected to the tubing string 4. At this point, the upper, threaded section 152 is coupled at a joint 156 to the lower sections. The upper end of this threaded section extends concentrically through the piston 88 and out the opposite end of the piston 88. The split nut elements 154 are placed around this extended end of the threaded section 152 and the adapter 70 is placed over this subassembly and threadedly coupled at the joint 72 to the adapter 68 so that the nut elements are locked to the threaded section 152 at the specific distance between the vent 8 and the actuating means 10.

The engagement means 150 shown in FIG. 2 is of a type which allows the connector means to be connected to the vent sleeve 32 in response to downward movement of the connector means relative to the vent sleeve 32. This permits connection of the actuating means 10 to the vent 8 after the vent has already ben made up into the tubing string 4 and lowered into the well bore 6. The preferred embodiment of the engagement means 150 includes a pull mandrel 158 having a threaded upper end connected to the lowermost section 152 of the inner pull string 148. The opposite end of the mandrel 158 has a lower rim 160 with a lower beveled surface 162 for engaging the beveled surface 64 of the inner vent sleeve 32 when the mandrel 158 is in a lowermost position. The rim 160 has an upper beveled surface 164 for engaging beveled surfaces 166 of resilient threaded collet latch fingers 168 of a collet member 170 forming another part of the engagement means 150. The collet member or latch 170 is mounted on the mandrel 158 so that the mandrel 158 can move longitudinally relative to the collet member 170, but so that the collet member 170 will rotate with the mandrel 158 in response to a rotational force applied to the mandrel 158 through the inner pull string 148. This is achieved in the illustrated embodiment by a plurality of splines 172 extending radially outwardly from the mandrel 158 through slits 174 defined in the concentric collet member 170.

Mandrel 158 has an outer surface 176 having a smaller diameter than an inner surface 178 of the collet latch fingers 168 so that the collet latch fingers 168 can be deflected radially inwardly a short distance when the mandrel 158 is positioned in the downward position relative to the collet member 170 illustrated in FIG. 2.

The connector means is utilized by lowering the engagement means 150 connected at the bottom of the pull string 148 downwardly through the tubing string 4 until the latch fingers 168 engage the threaded surface 66 of the inner vent sleeve 32. Further downward movement of the connector means ratchets the threaded collet fingers 168 over the thread crests of the surface 66 until the fingers 168 are fully seated on the surface 66 as illustrated in FIG. 2. During this movement the mandrel 158 is in the relatively downward position to allow inward ratcheting movement of the fingers 168 over the threaded surface 66.

When the differential pressure acting upwardly on the piston 88 is sufficient so that it breaks the shear pin 146 and moves the piston 88 upwardly within the piston housing of the actuating means 10, this upward movement of the piston 88 pulls the inner string 148 and thus the mandrel 158 relatively upward so that the beveled surface 164 engages and beveled surfaces 166 of the latch fingers 168. This secures the latch fingers 168 to the inner vent sleeve 32 during actuation of the vent 8 to its open state. With the collet fingers 168 so locked, further upward movement of the mandrel 158 acts against the locked collet member 170 to pull the connected vent sleeve 32 upward until the ring 34 snaps outwardly to engage the annular surface 26 of the vent body 18.

Although the engagement means 150 of the preferred embodiment is illustrated as being of the type which allows a stabbing connection of the actuating means 10 to the vent 8 after the vent 8 has been lowered into the well bore 6, the engagement means 150 can be of any suitable type providing another type of desirable interconnection. For example, a threaded connection could be used which requires the vent 8 and the actuating means 10 to be connected together prior to being connected in the tubing string or otherwise prior to the vent 8 being lowered into the well bore 6. If, however, the preferred embodiment of the engagement means 150 is used, it will be appreciated that the ratcheted connection between the collet fingers 168 and the surface 66 can be readily disconnected by applying a rotational force to the mandrel 158 in a direction tending to unscrew the threadedly connected collet fingers 166 and threaded surface 66. This rotational force imparted to the mandel 158 is communicated through the splines 172 to the collet member 170. The inner vent sleeve 32 is retained against such rotating force by means of the pipe plugs 58 held within the longitudinal grooves 56 of the vent sleeve 32.

Although the foregoing described the preferred embodiment of the actuating means 10, it is contemplated that the actuating means 10 can be implemented by any suitable means for providing an operating action to the vent 8 in response to the biasing force which exists or is caused to exist at a location spaced from the vent 8 and to which the actuating means 10 responds (e.g., a pressure differential between the annulus 15 pressure and the tubing string 4 pressure). For example, the actuating means could include a fuse or an explosive which is ignited by the biasing force to provide a chemical reaction or a percussion communicated to the vent 8. Other chemical reactions or secondary forces initiated by the initial biasing force could also likely be used. Additionally, a hydraulic response to the biasing force could likey be used. Other suitable means could likely be used and remain within the scope of the present invention directed broadly to an apparatus in which a vent is operated by a remote force within a well.

The foregoing description of the preferred embodiment of the vent 8 and the actuator 10 sets forth the basic structural and functional features of the preferred embodiment of the present invention; however, the utility of the invention can be extended by also incorporating the coupling means 16 for coupling the vent 8 and the perforator 14 so that actuation of the vent 8 by the actuator 10 also provides an initiating force to the perforator 14. That is, this coupling means provides means for communicating the single upward movement, which is applied to the inner vent sleeve 32 through movement of the connector string 147 in response to the differential pressure force acting on the piston 88, to the perforator at the same time it is applied to the inner vent sleeve 32. Thus, the coupling means 16 is responsive to the same external force to which the actuating means is responsive. In general, the coupling means 16 can be implemented by any suitable linkage (mechanical or otherwise) between the movable piston 88 and the perforator 14; however, in the preferred embodiment, it is contemplated that such linkage will be by a mechanical connection between the inner vent sleeve 32 and the perforator 14. An example of such a suitable mechanical linkage is illustrated in FIGS. 4A and 4B.

Figure 4A:
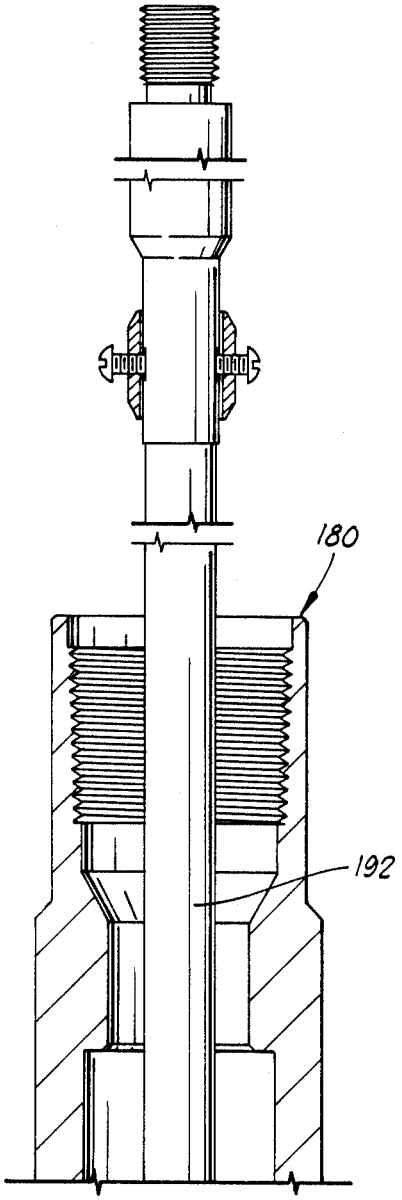
FIGS. 4A and 4B illustrate a means for coupling the vent subassembly to the perforator.
Figure 4B:
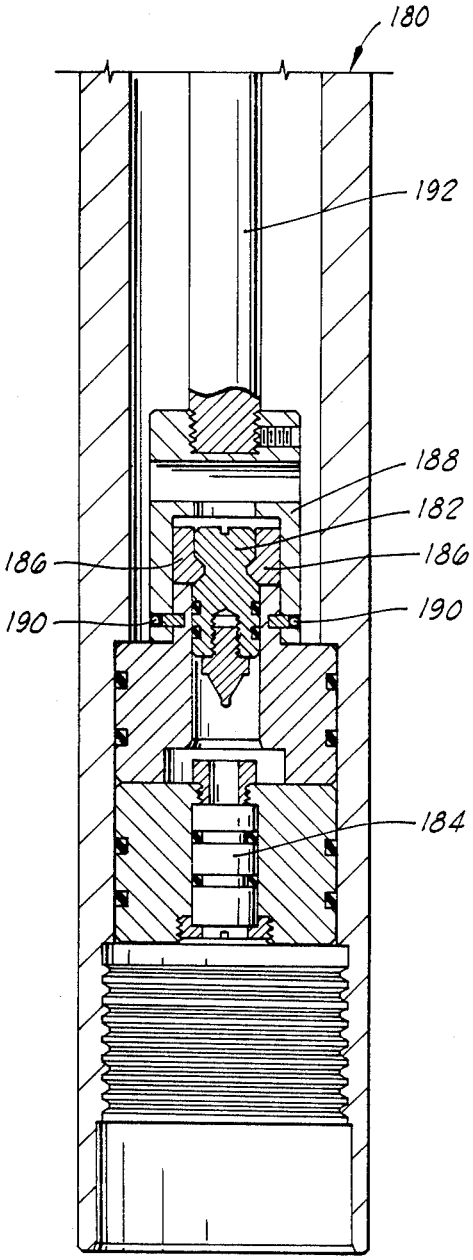

An example of a detonator 180 forming part of the perforator 14 is illustrated in FIGS. 4A and 4B as including a firing piston 182 retained in spaced relationship from an initiator charge 184 by means of retaining dogs 186 held against the firing piston 182 by a retaining collar 188. The collar 188 is held in its initial position illustrated in FIG. 4B by shear pins 190. These elements function in a manner as known to the art in that when the holding strength of the shear pins 190 is overcome, the retaining collar 188 is pulled away from the dogs 186 which are thus released from their engagement with the firing piston 182. This release is generally in response to a pressure within the detonator housing 180. This pressure also acts on the firing piston 182 to move it into engagement with the initiator charge 184, thereby commencing the firing of a perforating gun (not shown) to which the detonator housing 180 is connected in a known manner.

In the illustrated embodiment, detachment of the shear pins 190 is effected by a force applied to the shear pins 190 through a pull rod 192. This pull rod 192 forms part of the coupling means 16 so that the force applied therethrough to the shear pins 190 is from the same force used to move the inner vent sleeve 32 from its closed position adjacent the openings 28, 30 to its open position. the free end of the pull rod 192 shown at the top of FIG. 4A is connected to the inner vent sleeve 32 by any suitable means, such as a spider connected across the surface 60 of the vent sleeve 32. This spider can have a central threaded hub into which the threaded free end of the pull rod 192 is connected. Such a spider can further include radial spokes or arms extending to a circumferential rim connected, such as by welding, to the vent sleeve 32. Spaces between the radial spokes or arms allow fluid communication through the end of the vent sleeve 32.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. An apparatus for perforating a casing containing fluid therein in a well and for controlling the flow of fluids into said apparatus from said casing containing fluid therein and from a formation of the earth behind said casing in said well, said apparatus comprising:

a tubing string disposed in said well in spaced relation to said casing so that an annulus is defined therebetween, said tubing string adapted to conduct a fluid therethrough and containing a fluid therein and said tubing string including:

tubing sections extending from the top of said well thereinto;

packer means connected to said tubing sections and set in said casing in said well for dividing said annulus into an upper annular portion located above said packer means and a lower annular portion located below said packer means; and perforating means, connected to said tubing sections below said packer means, for perforating said casing;

vent means, connected to said tubing string and located below said packer means, for preventing the flow of fluid between said lower annular portion and said tubing string through said vent means when said vent means is closed and for permitting the flow of fluid between said lower annular portion and said tubing string through said vent means when said vent means is open;

actuating means, connected to said tubing string and located above said packer means, for actuating said vent means in response to the differential in fluid pressure of said fluid within said casing in said upper annular portion and the fluid pressure of the fluid within said tubing string; and coupling means, coupling said perforating means and said vent means, for initiating the operation of said perforating means in response to said actuating means actuating said vent means.

2. An apparatus as defined in claim 1, wherein said actuating means includes means for communicating a positional displacing movement through said packer means to said vent means in response to said differential in fluid pressure.

3. An apparatus as defined in claim 1, wherein said actuating means includes:

movement means, connected to said tubing string, for imparting a positional displacing movment; and connector means, having a variable length, for connecting said movement means to said vent means at a selectable distance above said vent

4. An apparatus as defined in claim 1, wherein said actuating means includes connector means for connecting said actuating means to said vent means, said connector means including engagement means for engaging said connector means with said vent means after said vent means has been connected in said tubing string and lowered through the mouth of said well.

5. An apparatus as defined in claim 1, wherein said actuating means includes:

a piston housing connectible into said tubing string;

a piston disposed in said piston housing;

connector means for connecting said piston to said vent means; and holding means for holding said piston stationary relative to said piston housing until said differential in said fluid pressures acting on said holding means exceeds a predetermined magnitude.

6. An apparatus as defined in claim 1, wherein said vent means includes latch means for latching said vent means open after said vent means has been actuated by said actuating means.

7. An apparatus as defined in claim 1 wherein:

said vent means includes: a vent body connectible to said tubing string; and a vent sleeve slidably received in said vent body;

said actuating means includes connector means for connecting said actuating means to said vent sleeve so that said connector means can be disconnected from said vent sleeve in response to a rotational force applied to said connector means; and said vent means further includes means for preventing said vent sleeve from rotating relative to said vent body when the rotational force is applied to said connector means.

8. An apparatus as defined in claim 1, wherein:

said vent means includes:

a vent body; and a vent sleeve slidably connected to said vent body; and said actuating means includes:

a piston housing;

a piston disposed in said piston housing and responsive to said differential in fluid pressure; and connector means for connecting said piston to said vent sleeve.

9. An apparatus as defined in claim 8, wherein said connector means includes:

an inner tubing having a lower end connectible to said vent sleeve and having a threaded upper and extending above said piston; and split nut means, disposed above said piston between an inner surface of said piston housing and said threaded upper end of said inner tubing, for engaging said threaded upper end.

10. An apparatus as defined in claim 8, wherein said actuating means further includes:

an inner collar engaging a surface of said piston;

an outer collar disposed radially outward from said inner collar and engaging surface of said piston housing;

a split support ring engaging said inner collar and said piston; and a shear pin extending between said inner and outer collars.

11. An apparatus as defined in claim 8, wherein said vent means further includes a resilient C-ring mounted on said vent sleeve so that said C-ring engages a locking surface of said vent body when said vent sleeve moves relative to said vent body to open said vent means.

12. An apparatus as defined in claim 8, wherein said connector means includes:

a tubing connected to said piston; and engagement means, connected to said tubing, for engaging an engagement surface of said vent sleeve in response to downward movement of said engagement means relative to said vent sleeve.

13. An apparatus as defined in claim 12, wherein said engagement means includes:

a mandrel connected to said tubing, said mandrel having a lower rim; and a collet member mounted on said mandrel so that said collet member is rotatable with said mandrel but so that said mandrel is longitudinally movable relative to said collet member, said collet member having resilient collet fingers for engaging the engagement surface of said vent sleeve in response to the downward movement of said engagement means relative to said vent sleeve and for being held against the engagement means by said rim of said mandrel in response to subsequent upward movement of said mandrel relative to said collet member.

14. An apparatus as defined in claim 8, wherein:

said connector means is connected to said vent sleeve so that said connector means can be disconnected from said vent sleeve in response to a rotational force;

said vent sleeve has a longitudinal groove defined therein; and said vent means further includes a plug connected through said vent body into said groove so that said vent sleeve is movable longitudinally relative to said vent body in response to said differential in fluid pressure acting on said piston but so that said vent sleeve is held by said plug against rotation relative to said vent body when the rotational force is applied to said connector means to disconnect said connector means from said vent sleeve.

15. An apparatus as defined in claim 1 wherein:

said vent means includes:

a vent body connectable to said tubing string;

a vent sleeve slidably received in said vent body; and means for preventing said vent sleeve from rotating relative to said vent body;

said actuating means includes:

connector means for connecting said actuating means to said vent sleeve so that said connector means can be disconnected from said vent sleeve in response to a rotational force applied to said connector means;

said perforating means includes a firing head; and said coupling means includes a firing head connector means having a portion thereof connected to said vent sleeve of said vent means and having a portion thereof connected to said firing head of said perforating means.

16. An apparatus for perforating a casing containing fluid therein in a well and for controlling the flow of fluids into said apparatus from said casing containing fluid therein and from a formation of the earth behind said casing in said well, said apparatus comprising:

a tubing string disposed in said well in spaced relation to said casing so that an annulus is defined therebetween, said tubing string adapted to conduct a fluid therethrough and containing a fluid therein and said tubing string including:

tubing sections extending from the top of said well thereinto; and packer means connected to said tubing sections and set in said casing in said well for dividing said annulus into an upper annular portion located above said packer means and a lower annular portion located below said packer means;

vent means, connected to said tubing string and located below said packer means, for preventing the flow of fluid between said lower annular portion and said tubing string through said vent means when said vent means is closed and for permitting the flow of fluid between said lower annular portion and said tubing string through said vent means when said vent means is open; and actuating means, connected to said tubing string and located above said packer means, for actuating said vent means in response to the differential in fluid pressure of said fluid within said casing in said upper annular portion and the fluid pressure of the fluid within said tubing string, said actuating means including:

a piston housing connectible into said tubing string;

a piston disposed in said piston housing;

connector means for connecting said piston to said vent means; and holding means for holding said piston stationary relative to said piston housing until said differential in said fluid pressures acting on said holding means exceeds a predetermined magnitude.

17. An apparatus as defined in claim 16, wherein said holding means includes:

an inner collar engaging a surface of said piston;

an outer collar disposed radially outward from said inner collar and engaging a surface of said piston housing;

a split support ring engaging said inner collar and said piston; and a shear pin extending between said inner and outer collars.

18. An apparatus as defined in claim 16, wherein said vent means includes latch means for latching said vent means open after said vent means has been actuated by said actuating means.

19. An apparatus as defined in claim 18, wherein:

said vent means includes: a vent body; and a vent sleeve slidably connected to said vent body; and said latch means includes a resilient C-ring mounted on said vent sleeve so that said C-ring engages a locking surface of said vent body when said vent sleeve moves relative to said vent body to open said vent.

20. An apparatus for perforating a casing containing fluid therein in a well and for controlling the flow of fluids into said apparatus from said casing containing fluid therein and from a formation of the earth behind said casing in said well, said apparatus comprising:

a tubing string disposed in said well in spaced relation to said casing so that an annulus is defined therebetween, said tubing string adapted to conduct a fluid therethrough and containing a fluid therein and said tubing string including:

tubing sections extending from the top of said well thereinto; and packer means connected to said tubing sections and set in said casing in said well for dividing said annulus into an upper annular portion located above said packer means and a lower annular portion located below said packer means;

vent means, connected to said tubing string and located below said packer means, for preventing the flow of fluid between said lower annular portion and said tubing string through said vent means when said vent means is closed and for permitting the flow of fluid between said lower annular portion and said tubing string through said vent means when said vent means is open, said vent means including:

a vent body connected to said tubing string; and a vent sleeve slidably received in said vent body;

actuating means, connected to said tubing string and located above said packer means, for actuating said vent means in response to the differential in fluid pressure of said fluid within said casing in said upper annular portion and the fluid pressure of the fluid within said tubing string, said actuating means including:

connector means for connecting said actuating means to said vent sleeve so that said connector means can be disconnected from said vent sleeve in response to a rotational force applied to said connector means; and said vent means further including means for preventing said vent sleeve from rotating relative to said vent body when the rotational force is applied to said connector means.

21. An apparatus as defined in claim 20, wherein said means for preventing said vent sleeve from rotating includes:

a longitudinal groove defined in said vent sleeve; and a plug connected through said vent body into said groove so that said vent sleeve is movable longitudinally relative to said vent body in response to said differential in fluid pressure acting on said actuating means but so that said vent sleeve is held by said plug against rotation relative to said vent body when the rotational force is applied to said connector means to disconnect said connector means from said vent sleeve.

22. An apparatus as defined in claim 20, wherein:

said actuating means further includes:

a piston housing; and a piston disposed in said piston housing and responsive to said differential in fluid pressure; and said connector means includes:

a tubing having a threaded upper end extending above said piston;

split nut means, disposed above said piston between an inner surface of said piston housing and said threaded upper end of said tubing, for engaging said threaded upper end; and engagement means, connected to said tubing, for engaging an engagement surface of said vent sleeve in response to downward movement of said engagement means relative to said vent sleeve.

23. An apparatus as defined in claim 20, wherein:

said actuating means further includes:

a piston housing; and a piston disposed in said piston housing and responsive to said differential in fluid pressure; and said connector means includes:

a tubing connected to said piston; and engagement means, connected to said tubing, for engaging an engagement surface of said vent sleeve in response to downward movement of said engagement means relative to said vent sleeve, said engagement means including:

a mandrel connected to said tubing, said mandrel having a lower rim; and a collet member mounted on said mandrel so that said collet member is rotatable with said mandrel but so that said mandrel is longitudinally movable relative to said collet member, said collet member having resilient collet fingers for engaging the engagement surface of said vent sleeve in response to the downward movement of said engagement means relative to said vent sleeve and for being held against the engagement means by said rim of said mandrel in response to subsequent upward movement of said mandrel relative to said collet member.

24. An apparatus for communicating an annulus outside a tubing string with an interior of the tubing string when the tubing string is disposed in a well, comprising:

a vent connectible into the tubing string and controllable between a closed state, wherein an annulus outside the tubing string is not communicated to the interior of the tubing string through said vent, and an open state, wherein an annulus outside the tubing string is communicated to the interior of the tubing string through said vent, said vent including:

a vent body;

a vent sleeve slidably connected to said vent body; and actuating means, disposable in the well, for actuating said vent to one of said states in response to a differential bias acting on said actuating means within the well at a location spaced from said vent, said actuating means including:

a piston housing;

a piston disposed in said piston housing and responsive to said differential bias; and connector means for connecting said piston and said vent sleeve, said connector means including:

a tubing connected to said piston; and engagement means, connected to said tubing, for engaging an engagement surface of said vent sleeve in response to downward movement of said engagement means relative to said vent sleeve, said engagement means including:

a mandrel connected to said tubing, said mandrel having a lower rim; and a collet member mounted on said mandrel so that said collet member is rotatable with said mandrel but so that said mandrel is longitudinally movable relative to said collet member, said collet member having resilient collet fingers for engaging the engagement surface of said vent sleeve in response to the downward movement of said engagement means relative to said vent sleeve and for being held against the engagement means by said rim of said mandrel in response to subsequent upward movement of said mandrel relative to said collet member.

* * * * *

UNITED STATES PATENT AND TRADEMARK OFFICE

CERTIFICATE OF CORRECTION

PATENT NO. : 4,732,211

DATED : March 22, 1988

INVENTOR(S) : David M. Haugen et al.

It is certified that error appears in the above-identified patent and that said Letters Patent is hereby corrected as shown below:

In column 6, line 46, delete the word [rlationship] and insert therefor --relationship--.

In column 9, line 46, delete the word [described] and insert therefor --describes--.

Signed and Sealed this

Eighteenth Day of October, 1988

*Attest:*

DONALD J. QUIGG

*Attesting Officer*

*Commissioner of Patents and Trademarks*